United States Patent [19]

Maudal

[11] Patent Number: 4,757,961

[45] Date of Patent: Jul. 19, 1988

[54] TORQUE BALANCED RATE GYRO DERIVING ITS SPIN FROM A HOST PROJECTILE

[75] Inventor: Inge Maudal, Claremont, Calif.

[73] Assignee: Aerojet-General Corporation, La Jolla, Calif.

[21] Appl. No.: 850,709

[22] Filed: Apr. 11, 1986

[51] Int. Cl.[4] ..... F41G 7/20

[52] U.S. Cl. ..... 244/3.23; 244/3.20; 74/5 F

[58] Field of Search ..... 244/3.20, 3.21, 3.23, 244/3.15; 74/5 F

[56] References Cited

U.S. PATENT DOCUMENTS 3,618,403 11/1971 Bilinski ..... 74/5 F 4,431,150 2/1984 Epperson, Jr. ..... 244/3.21

*Primary Examiner*—David H. Brown

*Assistant Examiner*—Michael J. Carone

*Attorney, Agent, or Firm*—Leonard Tachner

[57] ABSTRACT

A rate gyro instrument primarily for use in a gun fired spinning projectile eliminates all associated bearings by affixing the rotor to the spinning projectile body to obviate spin rotor bearings and by employing a flexible joint or constriction as a gimbal substitute to eliminate gimbal bearings.

10 Claims, 3 Drawing Sheets

TORQUE BALANCED RATE GYRO DERIVING ITS SPIN FROM A HOST PROJECTILE

BACKGROUND OF THE INVENTION

1. Field of the Invention

The present invention relates generally to guided artillery shells and more specifically, to spinning projectiles which utilize rate gyro instrumentation to provide electrical signals indicative of the time rate of change of attitude of such projectiles. A principal feature of the present invention is the use of such a rate gyro in a spinning projectile wherein the gyroscope rotor derives its spin from the projectile body and wherein a flexible joint serves as a gimbal bearing whereby to eliminate a spin motor with its associated bearings and also to eliminate gimbal bearings.

2. Prior Art

The use of rate gyros as instruments for providing an inertial reference in the navigation systems of aircraft and missiles is well-known. The need for a rate gyro instrument to provide a stable reference for a moving vehicle arises because of the high maneuverability and speed of aircraft and missiles and the lack of outside reference points. Rate gyros are attitude rate transducers which provide an output proportional to the anglar velocity or time rate of change of attitude of the vehicle. Typically, pick off points are provided in the gyroscope and provide an output which is representative of gimbal deflection about an output axis in response to attitude rate changes about an input axis. Gyro attitude transducers are usually designed as two degree of freedom gyros providing an output for each of two of a vehicle's three attitude planes. Such gyros provide an inner gimbal for one axis and an outer gimbal for the other axis with a separate pick off for each axis.

A variety of different torque producing devices may be used to spin a rotor to generate the basic gyroscopic action. Most typical, are ac or dc motors which are used to turn the rotor. Some gyros use a clock spring wound before each use or a pyrotechnic charge which when activated forces a stream of combustion gases into a small turbine.

With the growing sophistication of artillery shells which in fact provide the capability for some form of trajectory control, it has become advantageous to use such gyroscopes in artillery shells as well. Unfortunately, there are two substantial problems associated with using relatively sophisticated inertial reference gyro instrumentation in artillery shells. One such problem is that the gyro instrument can become a significant cost factor in the overall cost of a shell and because the artillery shell is clearly an expendable, the high manufacturing costs of an inertial reference instrument for an expendable projectile can be a significant disadvantage.

A second significant problem stems from the fact that a conventional gyroscope instrument utilizes a variety of bearings, bearings associated with the spin motor and bearings associated with the gimbals. Unfortunately, bearings do not normally survive well under the conditions of intense acceleration such as those which are incurred by a projectile in the gun tube. Gun fired projectiles may in fact be subject to acceleration exceeding 60,000 times the force of gravity. Thus, there is an inherent conflict between the conventional use of bearings in gyro instrumentation and the sensitivity of such bearings to forces of acceleration, particularly intense forces incurred in gun fired projectiles. In the past this conflict has been resolved by either significantly limiting the acceleration to which the projectile can be subjected, by limiting the operational mode of the gyroscope to protect the bearings during the initial firing of the projectile or perhaps more significantly, by utilizing bearings which are specially manufactured to withstand high acceleration stresses, which of course results in a more substantial cost of the instrument.

The present invention overcomes the aforementioned problems by eliminating all bearings in a rate gyro instrument used for inertial reference purposes in a gun fired projectile. This is accomplished by eliminating the spin motor and therefore, the associated bearings and by substituting a flexible joint for the gimbal thereby eliminating gimbal bearings.

The applicant knows of no prior art which combines the features of the present invention to entirely eliminate bearings thereby making it possible to utilize an inertial reference gyro in a gun fired projectile where operation of the gyro may be permitted during firing despite intense acceleration. The most relevant patents known to the applicant in this regard include the following U.S. Pat. Nos.:

3,281,094: Jasperson
3,585,866: Ensinger
4,116,404: Howell
4,189,948: Buckley et al.
4,286,370: Craig
4,291,849: Rodgers et al.
4,389,028: Kalivretenos et al.
4,397,185: Craig et al.
4,431,150: Epperson Jr.
Re. 30,290: Craig et al.

U.S. Pat. No. 4,431,150 to Epperson, Jr. is directed to a gyroscopically steerable bullet. The bullet is provided with a mechanism for locking the rotor of a gyroscope to the projectile body with the spin axis of the rotor and the projectile axis in a coincident line. The rotor is then spun when the projectile body is spun about its axis during launching. The bullet is also provided with means for unlocking the rotor after the projectile body and rotor have been spun during the launch phase so that the rotor may then spin freely thereafter. Means are provided to despin the projectile body while transferring angular momentum to the free spinning rotor.

U.S. Pat. No. 4,397,185 to Craig et al discloses an inertial instrument with a cup-shaped inertial mass. The rotor includes a flange which extends over the upper portion of the gimbal suspension. Within the interior of the rotor housing is a magnet and resting on the magnet is a pole piece supporting a second magnet. The pole piece separates the two magnets and is mounted over an upper bucking magnet to channel flux and enclose the magnetic field.

U.S. Pat. No. 4,286,370 to Craig is directed to a universal joint flexure hinge suspension system for a tuned inertial instrument.

U.S. Pat. No. 4,116,404 to Howell provides annular containers to dynamically balance a rocket during flight. The containers are filled with a high density fluid and when spin is induced in the rocket the radial center of gravity shifts to the spin axis and the fluid couples itself to the outside diameters of the rocket.

SUMMARY OF THE INVENTION

The principal feature of the present invention is the elimination of all bearings in a rate gyro instrument. The spin motor and associated bearings of a conventional gyro instrument are eliminated in the present invention by connecting the rotor of the gyro of the present invention to the spinning projectile body in which the gyro is contained. In addition, a conventional gimbal is replaced by a flexible joint which serves the conventional gimbal function of permitting the necessary degrees of freedom characteristic of the gyroscopic instrument.

A preferred embodiment of the invention comprises a rotor mass, a supporting post rigidly attached to the spinning projectile, a flexible joint in the form of a constriction in a stem interconnecting the supporting post and the rotor mass which permits flexing and angular motion at the rotor relative to the fixed structures and a magnetic or optical angle measuring device or pick off and/or torquer.

The rotor mass performs the same function as a conventional rotor but it is attached to and spins with the spinning projectile which gives the non-spinning rotor all the gyroscopic attributes of a conventional spinning rotor. This novel structure overcomes the aforementioned disadvantages of the prior art by providing a significant reduction in manufacturing costs as compared to a conventional gyro instrument. Also by the elimination of bearings the invention enhances the survival of the instrument under the intense acceleration of the projectile in the gun tube.

OBJECTS OF THE INVENTION

It is therefore a principal object of the present invention to provide a rate gyro in an attitude reference system for a gun fired spinning projectile which significantly reduces or entirely overcomes the noted disadvantages of the prior art.

It is an additional object of the present invention to provide a rate gyro for an attitude reference system for a gun fired spinning projectile for which the manufacturing cost is about only one-fifth of the cost of comparable prior art instruments.

It is still an additional object of the present invention to provide a rate gyro for an attitude reference system for use in a gun fired spinning projectile in which the gyro is designed to operate under intense acceleration such as experienced by the projectile while in the gun tube.

It is still a further object of the present invention to provide a significantly improved rate gyro for an attitude reference system for use in a gun fired spinning projectile wherein all bearings associated with the gyro have been eliminated.

It is still an additional object of the present invention to provide an improved rate gyro for an attitude reference system used in a gun fired spinning projectile wherein the gyro uses no spin motor and associated bearings because spin is derived from the host projectile and wherein there are no gimbal bearings because a flexible joint or constriction provides the flexibility normally provided by gimbal structures.

BRIEF DESCRIPTION OF THE DRAWINGS

The aforementioned objects and advantages of the present invention as well as additional objects and advantages thereof will be more fully understood hereinafter as a result of a detailed description of a preferred embodiment when taken in conjunction with the following drawings in which.

DETAILED DESCRIPTION OF A PREFERRED EMBODIMENT

Figure 1:
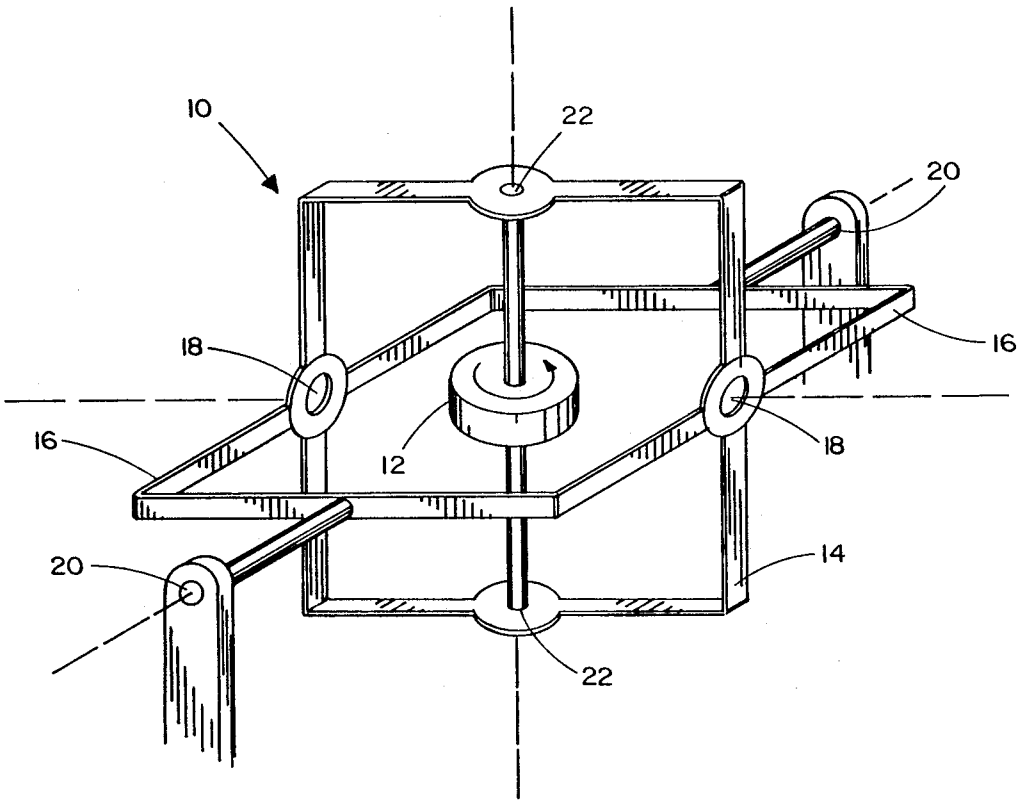
FIG. 1 PRIOR ART
FIG. 1 is a schematic representation of a gyro rotor and gimbal support of a conventional rate gyro instrument.

Referring first to FIG. 1 it will be seen that a conventional rate gyro 10 comprises a rotor mass 12 mounted within an inner gimbal frame 14 and an outer gimbal frame 16. The nature of the conventional rate gyro is to require a variety of bearings. More specifically, as seen in FIG. 1, inner gimbal frame 14 utilizes a pair of inner gimbal bearings 18 and outer gimbal frame 16 utilizes a pair of outer gimbal bearings 20. Furthermore, the spinning rotor mass 12 must utilize a pair of spin axis bearings 22 and usually a spin motor bearing as well. These bearings and gimbals permit the necessary degrees of freedom characteristic of a gyroscopic instrument. Unfortunately, such conventional spin bearings and gimbal bearings are relatively delicate and would substantially reduce the probability of survival of the gyro instrument within a projectile subjected to intense acceleration. Furthermore, the prior art configuration of conventional rate gyro 10 is generally too costly to use in an expendable artillery shell of which the overall cost is a critical parameter.

Figure 2:
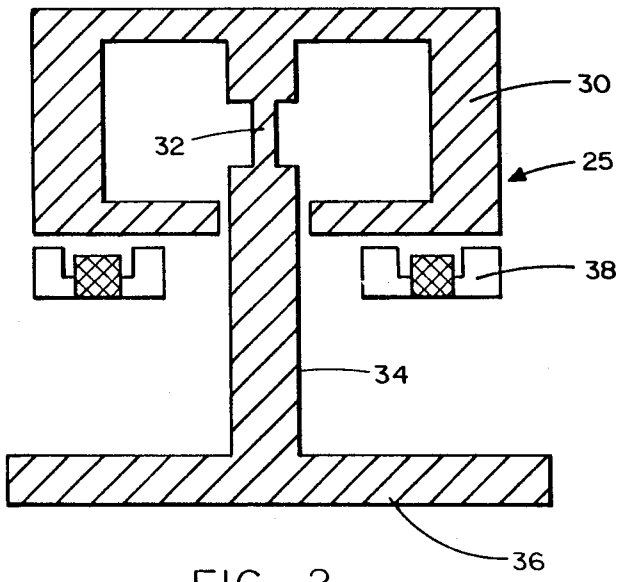
FIG. 2 is a schematic diagram of a preferred embodiment of the gyro instrument of the present invention.

The elimination of both gimbal bearings and spin rotor bearings is accomplished in the present invention, a simplified representation of which is shown in FIG. 2. As seen in FIG. 2, the rate gyro of the present invention comprises a rotor 30, a flexible suspension 32, a supporting post 34, a projectile body interface 36 and pick-off coils 38. Rotor 30 performs the same function as a conventional rotor, however it is attached to and spins with the spinning projectile. The attachment is made by means of a combination of the flexible suspension 32, the rigid supporting post 34 and the projectile body interface 36. The post 34 imparts the spin of the projectile to the rotor 30. The flexible suspension or constriction 32 provides the flexibility normally provided by gimbal structures. The pick-off 38 provides a torque and angle pick-off analogous to a conventional gyro instrument.

Figure 3:
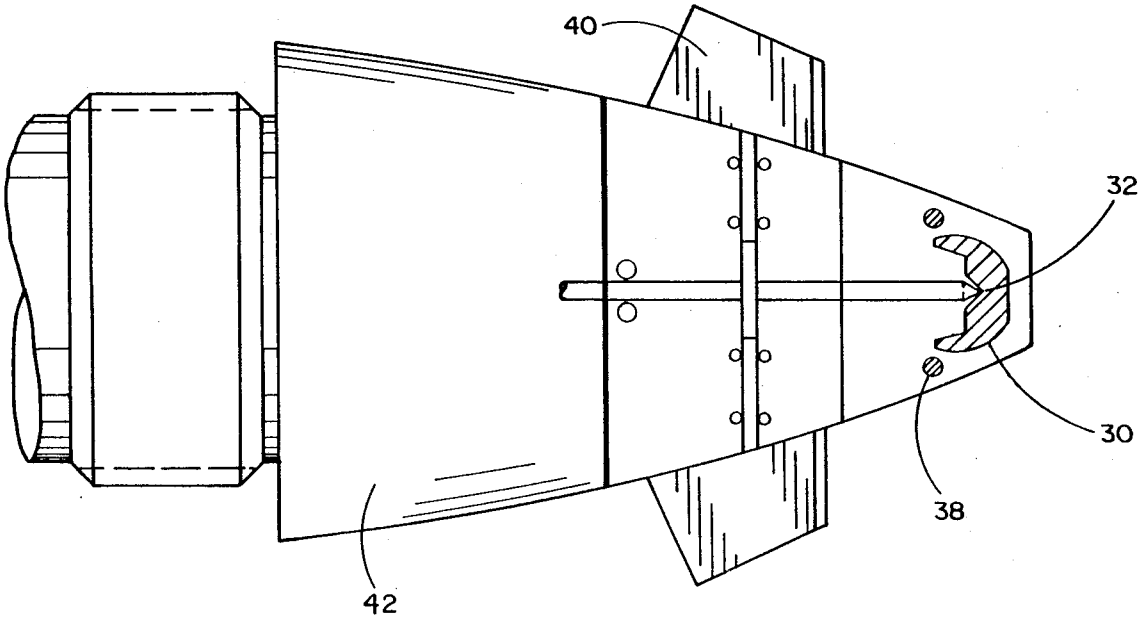
FIG. 3 is a simplified diagram of the present invention illustrating its position in the fuse section of a spinning projectile.

The configuration of the gyro instrument of the present invention relative to the spinning projectile is illustrated in FIG. 3. FIG. 3 shows the envelope of a standard projectile fuse. More specifically, as shown in FIG. 3 in the particular embodiment illustrated, the rotor or gyro mass 30 has been configured to conform to the substantially conical or ogive shape of the forward-most section of a spinning projectile 42. The projectile 42 includes a plurality of control canards 40 for achieving control of the projectile.

The gyro is rigidly attached to the spinning projectile by means of projectile body interface 36 of FIG. 2. The gyro spin axes are aligned with the projectile spin axes. Because the gyro is spinning with the projectile, the gyro will function in every respect as a conventional rate gyro. However, because the gyro is attached to the spinning projectile there is no need for a spin motor and there is no need for spin axes bearings.

Furthermore, flexible suspensional constriction 32 eliminates the prior art need for gimbal bearings. The absence of bearings enhances the survival of the gyroscope under the intense acceleration of the projectile in the gun tube and it also provides a significant improvement in manufacturing costs because of the significant simplification of the instrument and the elimination of all bearings. The size of such an instrument may be reduced because of its simplification. In one illustrative example, the instrument is a cylindrical shaped gyro of about one inch in diameter and about two inches in length.

It will now be understood that what has been disclosed herein is a gyro instrument primarily adapted for use in a gun fired spinning projectile but in which all bearings of the prior art have been eliminated. The spin motor and associated bearings of a conventional gyro instrument are eliminated in the present invention by connecting the rotor of the gyro to the spinning projectile body in which the gyro is contained. In addition, a conventional gimbal is replaced by a flexible joint constriction or suspension which serves the conventional gimbal function of permitting the necessary degrees of freedom characteristic of the gyroscope instrument.

A preferred embodiment of the present invention comprises a rotor mass, a supporting post rigidly attached to the spinning projectile, a flexible joint in the form of a constriction interconnecting the supporting post and the rotor mass and permitting flexing and angular motion at the rotor relative to the fixed structure. In addition, the present invention provides magnetic or optical angle measuring by means of a pick-off or torque coil.

Those having skill in the art to which the present invention pertains will now, as a result of the applicant's teaching herein, perceive various modifications and additions to the invention. More specifically, as illustrated herein, the shape of the rotor mass and the relative position of the constriction or suspension interconnecting the rotor mass and the projectile body may be readily varied depending upon the application to which the present invention is subjected. For example, the present invention may be employed with conventional inner and outer gimballs while deriving the benefits of a parasitic spin derived from the projectile. Accordingly, all such modifications and additions are deemed to be within the scope of the present invention which is to be limited only by the claims appended hereto.

I claim:

1. A projectile comprising:

means for inducing a spin of the body of said projectile;

a flight monitoring instrument having a rotor mass permanently connected internally to said projectile body by means of a post coincident with the spin axis of said projectile thereby causing said rotor mass to always spin at the same rate as said body; and means for permitting gimballing of said rotor mass in response to gyroscopically induced forces resulting from a change in attitude of said body.

2. In combination with a gun-fired spinning projectile, an improved gyroscopic instrument for monitoring flight parameters of said projectile; the improvement comprising:

a rotor mass;

means for permanently connecting said rotor mass to said projectile whereby said rotor mass is caused to spin by rotation of and at the same rate as said projectile; and means permitting bearingless gimballing of said rotor mass relative to said projectile in response to changes in the trajectory of said projectile.

3. The improvement recited in claim 1 wherein said connecting means comprises a post coincident with the axis of said rotor mass and wherein said gimballing means comprises a constriction in said post.

4. The improvement recited in claim 3 wherein said connecting means further comprises means in said projectile for affixing said post to the body of said projectile.

5. An artillery-type projectile which is spun upon being fired, the projectile having a gyro instrument for monitoring the flight parameters of the projectile and comprising:

a rotor mass;

means for permanently connecting said rotor mass to said projectile whereby said rotor mass is caused to spin by rotation of and at the same rate as said projectile; and means permitting bearingless gimballing of said rotor mass relative to said projectile in response to changes in the trajectory of said projectile.

6. The improvement recited in claim 5 wherein said connecting means comprises a post coincident with the axis of said rotor mass and wherein said gimballing means comprises a constriction in said post.

7. The improvement recited in claim 6 wherein said connecting means further comprises means in said projectile for affixing said post to the body of said projectile.

8. The projectile of claim 5 wherein said instrument is housed in the form of a cylinder approximately one inch in diameter and two inches in length.

9. The projectile recited in claim 5 wherein said rotor mass is shaped to conform substantially to the shape of the projectile surrounding said instrument.

10. The projectile recited in claim 9 wherein said shape of the projectile surrounding said instrument is ogive.

* * * * *